US008177213B2

(12) United States Patent
Hirabayashi

(10) Patent No.: US 8,177,213 B2
(45) Date of Patent: May 15, 2012

(54) ADJUSTABLE TRAY FOR PRINTER HAVING CUTTER

(75) Inventor: Kenichi Hirabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 190 days.

(21) Appl. No.: 12/691,686

(22) Filed: Jan. 21, 2010

(65) Prior Publication Data

US 2010/0187744 A1 Jul. 29, 2010

(30) Foreign Application Priority Data

Jan. 23, 2009 (JP) ..... 2009-012531

(51) Int. Cl.
*B65H 31/20* (2006.01)

(52) U.S. Cl. ..... 270/58.07; 271/213; 83/167; 83/157; 83/84

(58) Field of Classification Search ..... 270/5.02, 270/21.1, 52.09, 58.07; 271/213; 83/167, 83/157, 84, 86
See application file for complete search history.

(56) References Cited

U.S. PATENT DOCUMENTS 4,529,190 A * 7/1985 Goodwin et al. ..... 271/213
5,081,487 A * 1/1992 Hoyer et al. ..... 355/75
5,175,583 A * 12/1992 Noh et al. ..... 399/107
5,248,139 A * 9/1993 Garland et al. ..... 271/184
7,568,694 B2 * 8/2009 Sparer et al. ..... 271/207
2008/0122164 A1 * 5/2008 Sparer et al. ..... 271/207

FOREIGN PATENT DOCUMENTS

JP 05-186124 A 7/1993
JP 2002-241005 A 8/2002
JP 2005-169745 A 6/2005

* cited by examiner

*Primary Examiner* — Patrick Mackey
(74) *Attorney, Agent, or Firm* — Kilpatrick Townsend & Stockton LLP

(57) ABSTRACT

An image recording device can accumulate discharged paper neatly stacked in a paper tray even when the length of the discharged paper changes. An inkjet printer 1 that records images on and discharges roll paper 100 from a paper exit 25 has a cutter unit 80 that cuts the roll paper 100 after an image is recorded, and a discharge tray unit 30 that receives slips 110, 120 discharged from the paper exit 25 after being cut by the cutter unit 80. The discharge tray unit 30 is connected by a hinge at an incline to the case 10 so that the paper stop 42 disposed at the distal end of the discharge tray unit 30 is down, and is configured so that the length of the discharge tray unit 30 is adjustable, and the inclination angle of the discharge tray unit 30 is changed by the operation of shortening the length of the discharge tray unit 30 to a more horizontal angle than when the length of the discharge tray unit 30 is extended.

4 Claims, 6 Drawing Sheets

ADJUSTABLE TRAY FOR PRINTER HAVING CUTTER

This application claims priority to Japanese Patent Application No. 2009-012531, filed Jan. 23, 2009, the entirety of which is incorporated by reference herein.

BACKGROUND

1. Technical Field

The present invention relates to an image recording device that records images on a continuous recording medium.

2. Related Art

Image recording devices that record images to continuous paper and discharge the printed paper from a paper exit are known from the literature. See, for example, Japanese Unexamined Patent Appl. Pub. JP-A-2002-241005. Image recording devices of this type have a cutter for cutting the continuous paper to a specific length after the image is recorded, and accumulate the discharged paper that is cut by the cutter and discharged from the paper exit on a tray.

With this type of recording device, however, the length to which the paper is cut differs according to the printed image. A problem with this configuration of the related art is that because the tray is disposed at a fixed angle, the discharged slips may not accumulate in a neat stack in the tray when the length of the discharged paper varies because the paper may turn over when the cut length is short, and the discharged paper may cause a paper jam when the cut length is long because the form will not fit in the tray.

SUMMARY

The present invention is directed to solving the foregoing problem and provides an image recording device that can neatly store the discharged paper in the discharge tray even when the length of the discharged paper is different.

A first aspect of the invention is an image recording device that records images on and discharges continuous paper from a paper exit, including a device case with a cutter unit that cuts the continuous paper after an image is recorded, and a tray unit that has a receiving unit for receiving discharged paper that is cut by the cutter unit and discharged from the paper exit. The tray unit is connected to the device case so that the inclination angle at which the distal end part of the receiving unit slopes down can be changed, and is configured so that the length of the tray unit is adjustable, and the inclination angle of the tray unit is changed by the operation of shortening the tray unit length to a more horizontal angle than when the length of the tray unit is extended.

Because the inclination angle of the tray becomes steep when the length of the tray unit is extended in this aspect of the invention, discharged paper that is cut long can slide smoothly down the tray, and the discharged paper can be stacked neatly on the tray. Because the inclination angle of the tray changes to a more horizontal angle and the distance between the paper exit and the tray is reduced when the length of the tray unit is shortened, discharged paper that is cut short is prevented from turning over and the discharged paper can be neatly stacked on the tray.

In an image recording device according to another aspect of the invention, the tray unit includes a tray that is pivotably connected to the device case, and a sliding member that is slidably attached to the tray. The sliding member has a contact part that protrudes to the device case side from the back end part of the tray and contacts the device case when the length of the tray unit is shortened.

Because the sliding member in this aspect of the invention has a contact part that protrudes from the back end of the tray to the device case side and contacts the device case when the length of the tray unit is shortened, the inclination angle of the tray can be easily changed to a more horizontal angle as a result of the contact part contacting the device case. As a result, the operation that adjusts the length of the tray unit and the operation that changes the inclination angle of the tray unit can thus be executed simultaneously, and operability is improved.

An image recording device according to another aspect of the invention preferably has a locking means that is disposed between the tray and the sliding member, and fixes the sliding member to the tray.

Because the locking means in this aspect of the invention fixes the position of the sliding member to the tray, the length of the tray unit is prevented from changing, and the discharged paper that is discharged into the tray unit can be neatly stacked.

Yet further preferably, the tray unit is disposed to an access cover, of which the bottom end part is pivotably supported on the device case, so that the distal end part of the receiving unit can pivot up.

With this aspect of the invention, the access cover can open further after the tray unit touches the installation surface when the access cover opens.

Effect of the Invention

With the invention thus comprised, because the inclination angle of the tray unit changes when the length of the tray unit is shortened to a more horizontal angle than when the length of the tray unit is extended, the discharged paper can be neatly stacked in the tray when the length of the paper changes.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
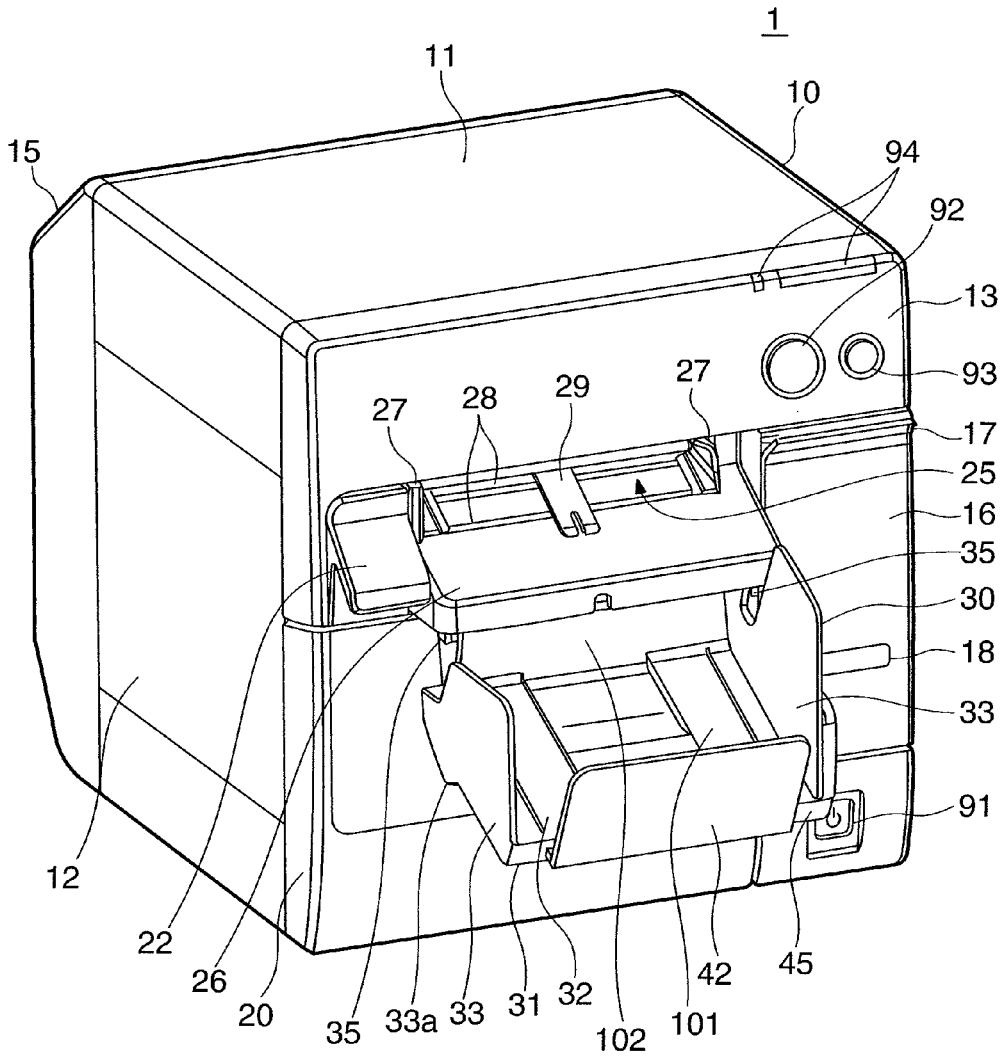
FIG. 1 is an oblique view of an inkjet printer according to a preferred embodiment of the invention.
Figure 2:
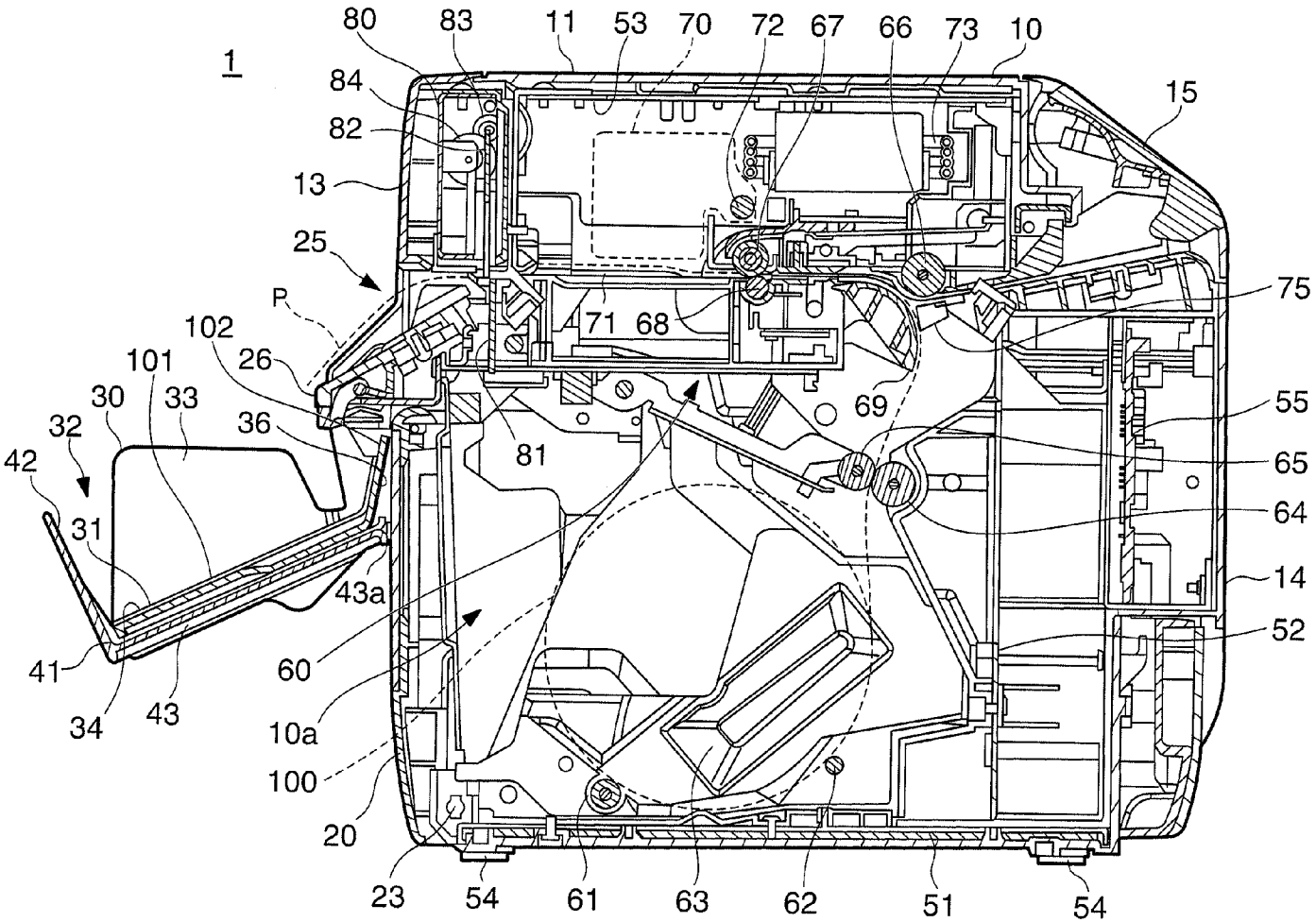
FIG. 2 is a section view of the inkjet printer.

FIG. 1 is an oblique view of an inkjet printer 1 according to a preferred embodiment of the invention. FIG. 2 is a section view of the inkjet printer 1. Note that in FIG. 2 the transportation path P of the roll paper 100 is indicated by an imaginary line.

The inkjet printer 1 (referred to as simply "printer 1" below) used as an example of an image recording device according to this embodiment of the invention is a printer that uses roll paper 100 (continuous paper) as the recording medium, and prints (records) images, including text, by discharging and depositing ink on the surface of the roll paper 100. The roll paper 100 is a sheet of paper or plastic, for example, wound into a roll.

The sheet used in the roll paper 100 may have a resin coating rendered on the sheet surface, or label paper having label stock with an adhesive coating on the back carried on a web liner may be used. This embodiment of the invention describes a configuration in which the roll paper 100 used in the printer 1 is label paper.

The printer 1 records an image on the roll paper 100, and then discharges the printed paper from a paper exit 25 rendered in the front of the printer 1. A cutter unit 80 (FIG. 2) is disposed before the paper exit 25 in the printer 1. The cutter unit 80 cuts the roll paper 100 to a specified length, and the portion that is cut off (the discharged paper) is discharged from the paper exit 25. The printer 1 can therefore print and output labels made by cutting the label paper (continuous paper) to a specified length.

As shown in FIG. 1, the printer 1 has a basically box-shaped case (device case) 10. The top of the case 10 is covered by a top panel 11, side panels 12 are disposed on the left and right sides of the case 10, and a back panel 14 (FIG. 2) is disposed at the back of the case 10 perpendicularly to the surface on which the printer 1 is placed.

A back top panel 15 is disposed connecting the top and back surfaces at the top back end of the case 10. A front top panel 13 is disposed at the top front part of the case 10. An ink cartridge loading door 16 and a roll paper cover 20 (access cover) are disposed side by side below the front top panel 13.

The ink cartridge loading door 16 is a door that is disposed so that it can open and close to the case 10 pivoting on a hinge (not shown in the figure) at the bottom end of the door. A storage unit in which an ink cartridge (not shown in the figure) is held is rendered inside the ink cartridge loading door 16. Ink cartridges can be loaded and removed by opening the ink cartridge loading door 16. A catch 17 that the user can hold with a finger when opening and closing the door is disposed at the top of the ink cartridge loading door 16, and a transparent window 18 is disposed in the bottom part for checking if an ink cartridge is loaded.

The roll paper cover 20 is supported pivotably to the case 10 of the printer 1 on a hinge unit 23 (FIG. 2) formed at the bottom end of the roll paper cover 20, and can open so that the top end of the roll paper cover 20 rotates facing down. The roll paper cover 20 is normally held in the closed position by a locking mechanism not shown so that the cover does not open. When a release lever 22 disposed at the top end of the roll paper cover 20 is operated, the lock mechanism is released and the roll paper cover 20 can be opened.

When the roll paper cover 20 is opened, the roll paper compartment 10*a*, which is a space used as a recording medium storage unit for storing the roll paper 100 inside the printer 1, is exposed (see FIG. 2), and the roll paper 100 can be loaded and replaced from the front of the printer 1.

The paper exit 25 opens at the top part of the roll paper cover 20, that is, at a place between the roll paper cover 20 and the front top panel 13. The paper exit 25 is a narrow opening that is long in the direction across the width of the roll paper 100, and an exit paper guide 26 connected to the bottom end of the paper exit 25 is disposed to the roll paper cover 20. The exit paper guide 26 has a slope that supports the roll paper 100 discharged from the paper exit 25 from below, and a pair of paper width guides 27 positioned at the top end of this slope to guide the roll paper 100 from the opposite sides of the paper width. The pair of paper width guides 27 preferably touch the sides of the roll paper 100.

Each of the paper width guides 27 can therefore be moved and adjusted to the width of the roll paper 100, and channels 28 for moving the paper width guides 27 extend in the sloped surface of the exit paper guide 26 across the width of the roll paper 100. A paper guide plate 29 is therefore disposed bridging the channels 28 between the pair of paper width guides 27. The roll paper 100 is discharged on top of this paper guide plate 29.

A discharge tray unit (tray) 30 is disposed below the exit paper guide 26. The discharge tray unit 30 is disposed so that the paper stop 42 (distal end part) disposed to the distal end of the discharge tray unit 30 is down, and the discharge tray unit 30 receives and collects the pieces of roll paper 100 that descend along the exit paper guide 26.

As shown in FIG. 2, the case 10 of the printer 1 has a frame including a bottom frame 51, a back frame 52, and a top frame 53 part.

The bottom frame 51 is a frame panel that supports the bottom part of the printer 1, and a plurality of feet 54 that contact the installation surface are affixed to the bottom frame 51.

The back frame 52 rises from the bottom frame 51, and the top frame 53 is affixed to the top part of the back frame 52. A control circuit board 55 on which various control circuits and devices that control the printer 1 are disposed is supported on the back side of the back frame 52.

The roll paper compartment 10*a* in which the roll paper 100 is stored is a space reserved between the bottom frame 51 and the top frame 53. A roll paper support roller 61 and a roll paper support bar 62 are disposed at the bottom of the roll paper compartment 10*a*.

The roll paper support roller 61 is disposed freely rotatably to the frame of the case 10, and together with the roll paper support bar 62 supports the roll paper 100 from the bottom so that the roll paper 100 can rotate easily. Roll paper pressers 63 that contact the sides of the roll paper 100 and stabilize the roll paper 100 are disposed on the left and right sides of the roll paper compartment 10*a*.

The roll paper 100 stored in the roll paper compartment 10*a* is pulled up. A first transportation roller 64 and a second transportation roller 65 are disposed in opposition at the top part of the roll paper compartment 10*a*, and convey the roll paper 100 that is pulled up therebetween. The first transportation roller 64 is driven by a transportation motor (not shown in the figure), and the second transportation roller 65 is a follower that follows the rotation of the first transportation roller 64.

A paper guide 69 that guides the roll paper 100 to the front is disposed above the first transportation roller 64 and second transportation roller 65, and a third transportation roller 66 is disposed opposite the paper guide 69. The third transportation roller 66 is driven by the transportation motor (not shown in the figure) noted above, and conveys the roll paper 100 forward.

A paper support unit 60 is disposed in front of the paper guide 69. The paper support unit 60 is supported by the top frame 53, and includes the parts that execute the process from recording an image on the roll paper 100 to discharging the paper from the paper exit 25.

The paper support unit 60 includes a fourth transportation roller 67 and a fifth transportation roller 68 for transporting the roll paper 100 that is conveyed forward by the third transportation roller 66, a platen 71 that supports the roll paper 100 from below, a recording head 70 that discharges ink to and records images on the roll paper 100 from above the platen 71, and the cutter unit 80 that cuts the roll paper 100 on which is an image has been recorded by the recording head 70.

The fourth transportation roller 67 is positioned above the transportation path P, and the fifth transportation roller 68 is disposed below the transportation path P of the roll paper 100 so that the rollers are in opposition. The fifth transportation roller 68 is driven by the foregoing transportation motor (not shown in the figure), and the fourth transportation roller 67 is a follower roller that follows the fifth transportation roller 68.

A guide shaft 72 that extends widthwise to the case 10 is disposed above the fourth transportation roller 67 and fifth transportation roller 68, and the recording head 70 travels on the guide shaft 72 bidirectionally across the width of the roll paper 100 when a head drive motor (not shown in the figure) is operated.

The recording head 70 is normally at a standby position on the ink cartridge loading door 16 (FIG. 1) side when not printing, and is denoted by an imaginary line in FIG. 2.

The recording head 70 is an inkjet recording head that discharges ink onto the surface of the roll paper 100 to record images. More specifically, ink supplied through an ink supply tube 73 from an ink cartridge (not shown in the figure) stored behind the ink cartridge loading door 16 is discharged onto the roll paper 100 from nozzles by means of a discharge mechanism using a piezoelectric device, for example.

The roll paper 100 passing between the recording head 70 and platen 71 is conveyed forward through the transportation path P by the transportation power of the fourth transportation roller 67 and fifth transportation roller 68 to the cutter unit 80.

The cutter unit 80 (cutter unit) includes a fixed knife 81 that is disposed inset below the transportation path P, and a movable knife 82 that is disposed above the transportation path P to slide against the fixed knife 81. The roll paper 100 is disposed between the fixed knife 81 and movable knife 82, which cut through both the label stock and the liner of the roll paper 100.

A cutter drive motor 83 and a cutter drive roller 84 that causes the movable knife 82 to move up and down using the torque of the cutter drive motor 83 are disposed to the movable knife 82, and the roll paper 100 is cut by the operation of the cutter drive motor 83 and the cutter drive roller 84.

When the roll paper 100 is cut by the cutter unit 80 and the leading end of the roll paper 100 is outside the paper exit 25, the weight of this portion causes the cut-off portion of the cut roll paper 100 to drop onto the exit paper guide 26 and be accumulated on the discharge tray unit 30.

The control circuit mounted on the control circuit board 55 drive the paper feed motor (not shown in the figure), the head drive motor (not shown in the figure), the discharge mechanism of the recording head 70, and the cutter drive motor 83 of the printer 1, and control the operating sequences related to conveying the roll paper 100, recording images on the roll paper 100, and cutting the roll paper 100.

In addition, as shown in FIG. 1, a power switch 91 for turning the power of the printer 1 on and off is disposed below the ink cartridge loading door 16. A cut button 92 for cutting the roll paper 100 by means of the cutter unit 80 (FIG. 2), and a feed button 93 for advancing the roll paper 100 a desired length, are disposed to the front top panel 13.

The control circuit mounted on the control circuit board 55 starts operation when the power switch 91 is operated and the power turns on, exchanges data and control signals with a host computer, for example, externally connected to the printer 1, and records images on the roll paper 100 as controlled by the host computer.

When the cut button 92 is operated, the control circuit operates the cutter drive motor 83 separately from cutting operations controlled by the host computer. When the feed button 93 is operated, the control circuit operates the paper feed motor (not shown in the figure) for as long as the feed button 93 is held depressed separately from paper feed operations controlled by the host computer.

An indicator 94 is also disposed at the front of the printer 1 as shown in FIG. 1. The indicator 94 in this embodiment of the invention includes a plurality of LEDs, and the control circuit mounted on the control circuit board 55 displays and outputs various messages, such as the operating status of the printer 1 and ink cartridge replacement prompts, by changing the illumination state of the plural LEDs of the indicator 94 to light steady, blink, or turn off appropriately.

Figure 3:
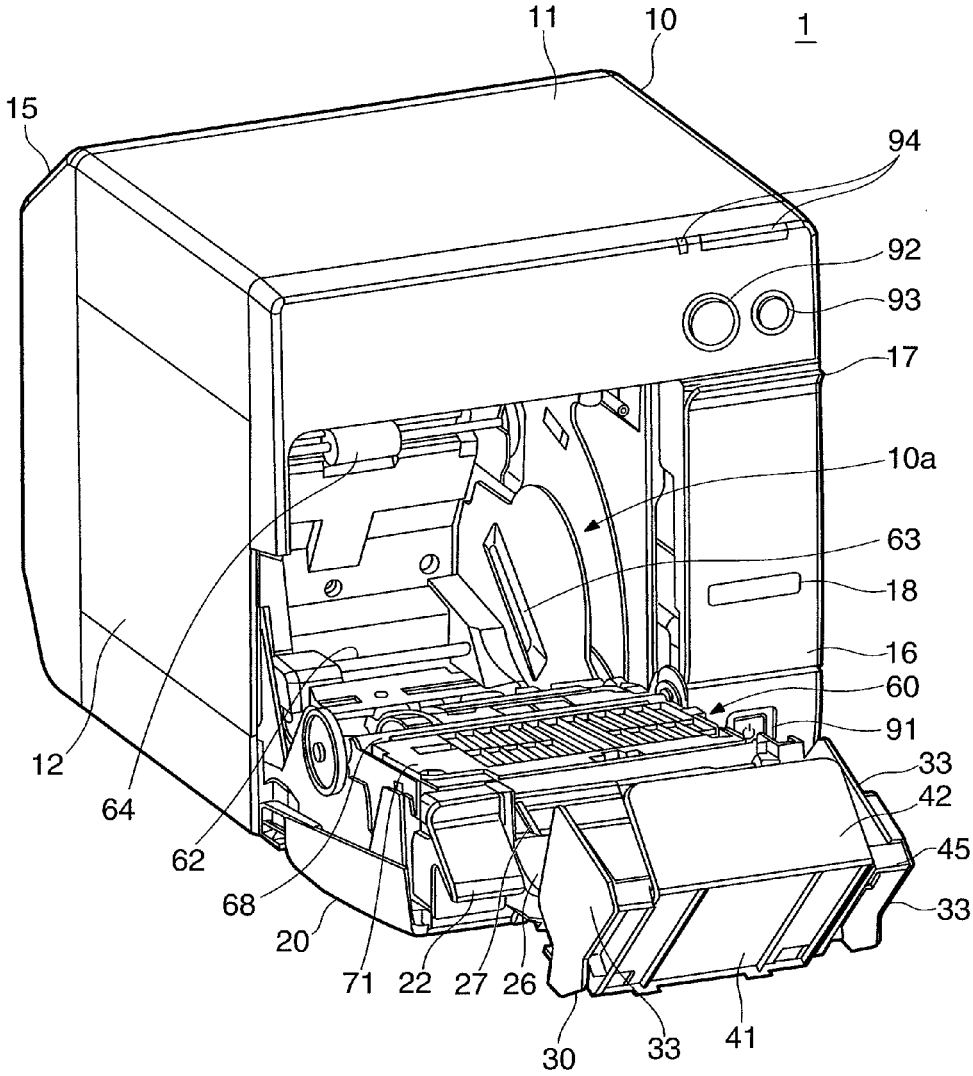
FIG. 3 is an oblique view of the inkjet printer when the roll paper compartment cover is open.

FIG. 3 is an oblique view of the printer 1 with the roll paper cover 20 open.

When the release lever 22 is operated and the lock is released, the roll paper cover 20 of the printer 1 pivots forward on the bottom end thereof and opens as shown in FIG. 3. When open as shown in FIG. 3, the second transportation roller 65, the fifth transportation roller 68, the paper guide 69, and the platen 71 move forward with the roll paper cover 20, and the roll paper compartment 10*a* is exposed.

To load the roll paper 100, the roll paper 100 is inserted to the roll paper compartment 10*a* that is open as shown in FIG. 3, the leading end of the roll paper 100 is pulled out and placed on the fifth transportation roller 68 and platen 71, and the roll paper cover 20 is then closed.

When the roll paper cover 20 closes, the roll paper 100 is held between the platen 71 and the recording head 70, between the fifth transportation roller 68 and the fourth transportation roller 67, between the paper guide 69 and the third transportation roller 66, and between the second transportation roller 65 and the first transportation roller 64. The roll paper 100 can thus be easily loaded in the transportation path P of the printer 1 shown in FIG. 2 by simply inserting the roll paper 100 with a leader pulled out into the roll paper compartment 10*a*, and then closing the roll paper cover 20.

Because the roll paper cover 20 pivots and drops forward when opened as shown in FIG. 3, the discharge tray unit 30 disposed to the roll paper cover 20 contacts the installation surface of the printer 1. Note that the discharge tray unit 30 pivots easily even after contacting the installation surface of the printer 1 so that there is no interference with opening the roll paper cover 20.

The configuration of the discharge tray unit 30 is described next.

Figure 4A:
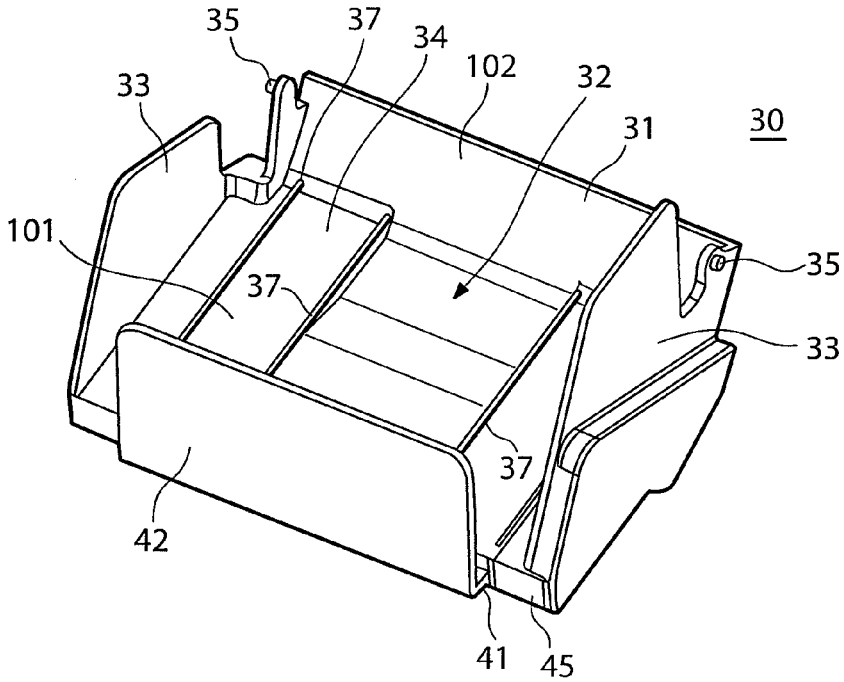
FIG. 4 is an oblique view of the discharge tray.
Figure 4B:
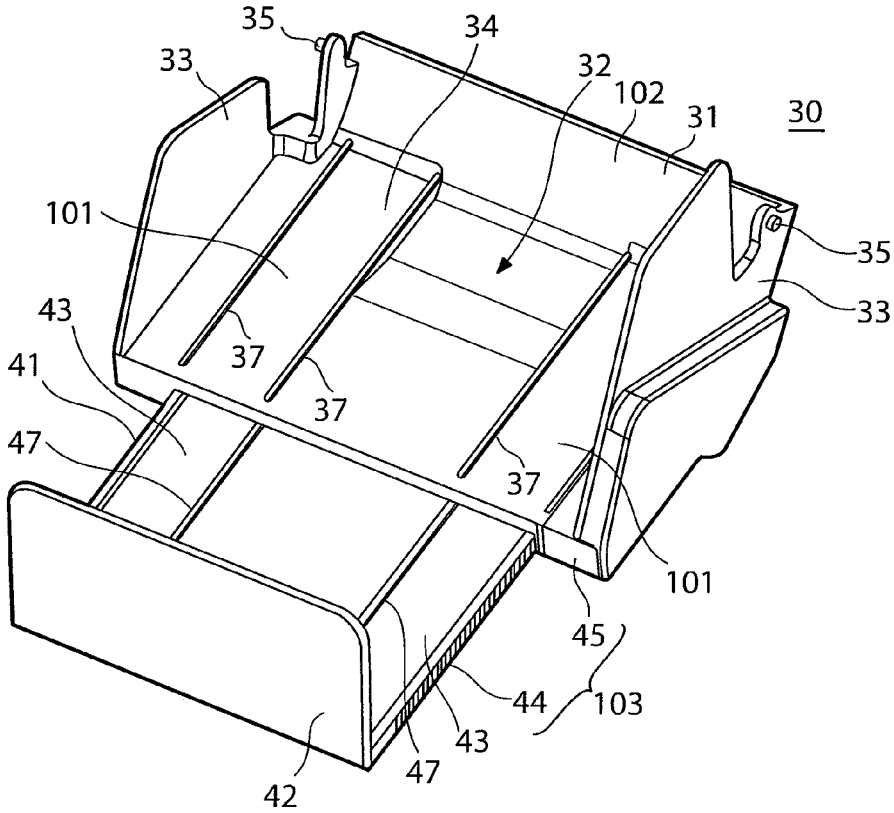

FIG. 4 is an oblique view showing the configuration of the discharge tray unit 30, FIG. 4B showing the length of the discharge tray unit 30 extended and FIG. 4A showing the discharge tray unit 30 when the length is shortened.

As shown in FIG. 4, the discharge tray unit 30 has a discharge tray 31 that primarily renders the receiving unit 32 in which the cut-off pieces of roll paper 100 are stored at a position below the exit paper guide 26, and a sliding member 41 that is slidably attached to the discharge tray 31. As shown in FIG. 1, the discharge tray 31 is hinged to the roll paper cover 20 so that the discharge tray 31 slopes down. More specifically, the discharge tray 31 has a bottom panel 101 that is formed as a downward incline similarly to the exit paper guide 26, and a pair of side walls 33 that rise from the opposite sides of the bottom panel 101. Engaging pins 35 (hinge pins) are disposed to the top part of the side walls 33, and these engaging pins 35 engage bearings (not shown in the figure)

disposed to the roll paper cover 20. A back wall 102 also rises at the back end of the bottom panel 101 between the side walls 33.

The sliding member 41 has a base unit 43 that is disposed freely slidably to the bottom panel 101 of the discharge tray 31, and a paper stop 42 that is disposed at the distal end of the base unit 43 and is positioned at the bottom end of the receiving unit 32 of the discharge tray unit 30. This paper stop 42 prevents the cut slips that are deposited in the receiving unit 32 from falling out, and functions to position the slips in a neat stack with the leading ends of the slips against the paper stop 42.

In this embodiment of the invention the receiving unit 32 is formed as the space enclosed by the bottom panel 101 of the discharge tray 31, the side walls 33, the back wall 102, and the paper stop 42 of the sliding member 41, and the length of the receiving unit 32 can be changed by moving the paper stop 42 between the position shown in FIG. 4A and the position shown in FIG. 4B by sliding the sliding member 41 relative to the discharge tray 31.

A mechanism 103 that secures the sliding member 41 to the discharge tray 31 is disposed between the discharge tray 31 and the sliding member 41. This mechanism 103 includes a rack 44 formed on the side of the base unit 43 of the sliding member 41, and a locking member 45 that is disposed to the bottom of the discharge tray 31, engages the rack 44, and holds the sliding member 41 at any position to which it is slid in or out. The length of the receiving unit 32 of the discharge tray unit 30, that is, the position to which the paper stop 42 of the sliding member 41 is pulled out, is preferably desirably adjusted according to the length of the roll paper 100 discharged from the paper exit 25.

The bottom panel 101 of the discharge tray 31 and the top of the base unit 43 of the sliding member 41 render a paper collection surface 34 on which the cut off pieces of roll paper accumulate. Ribs 37 enabling the pieces of roll paper 100 discharged from the paper exit 25 to flow smoothly to the paper stop 42 are formed on this paper collection surface 34, and ribs 47 are also formed on the sliding member 41.

Figure 5:
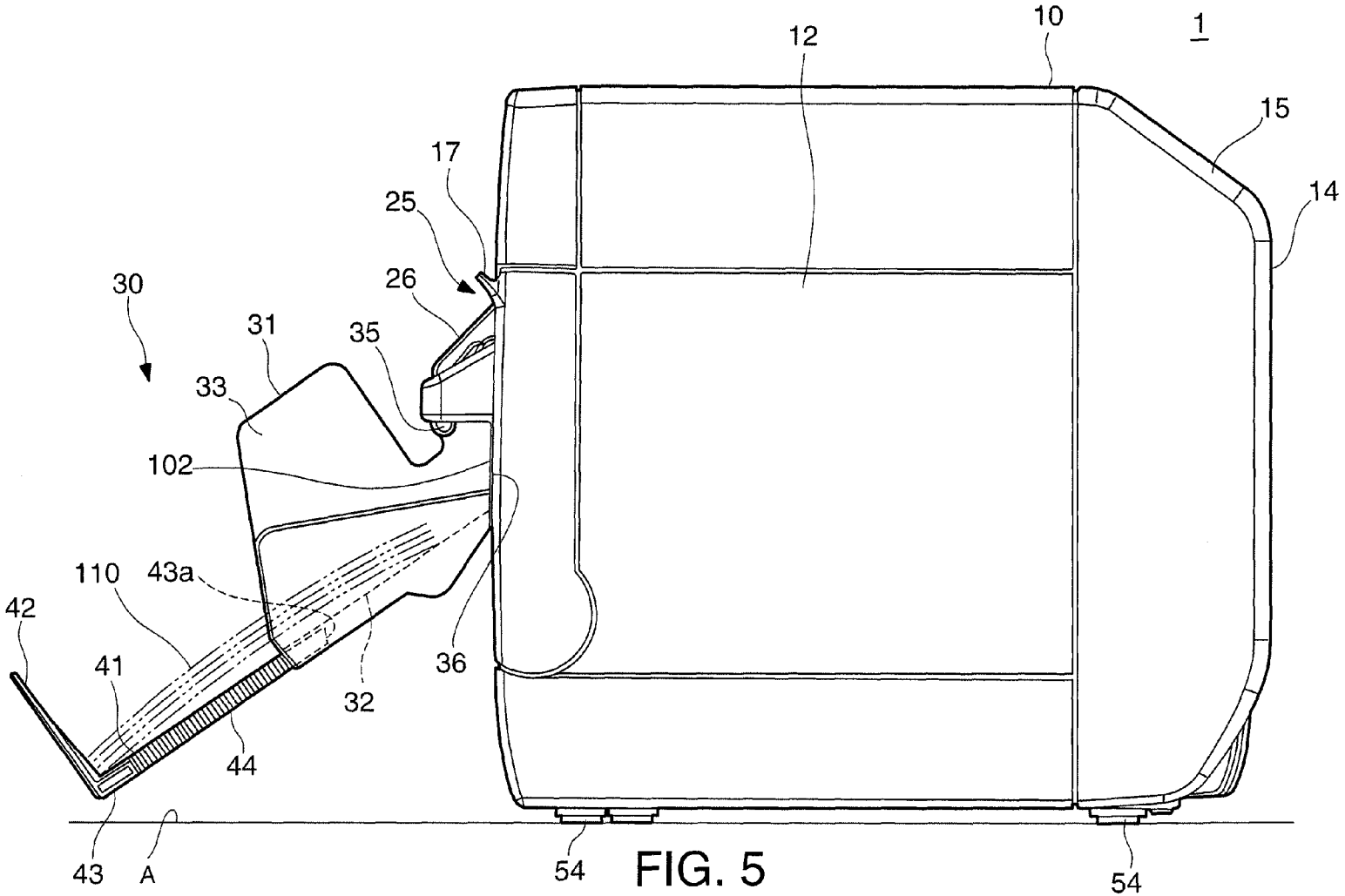
FIG. 5 is a side view of the printer when the length of the discharge tray is extended.
Figure 6:
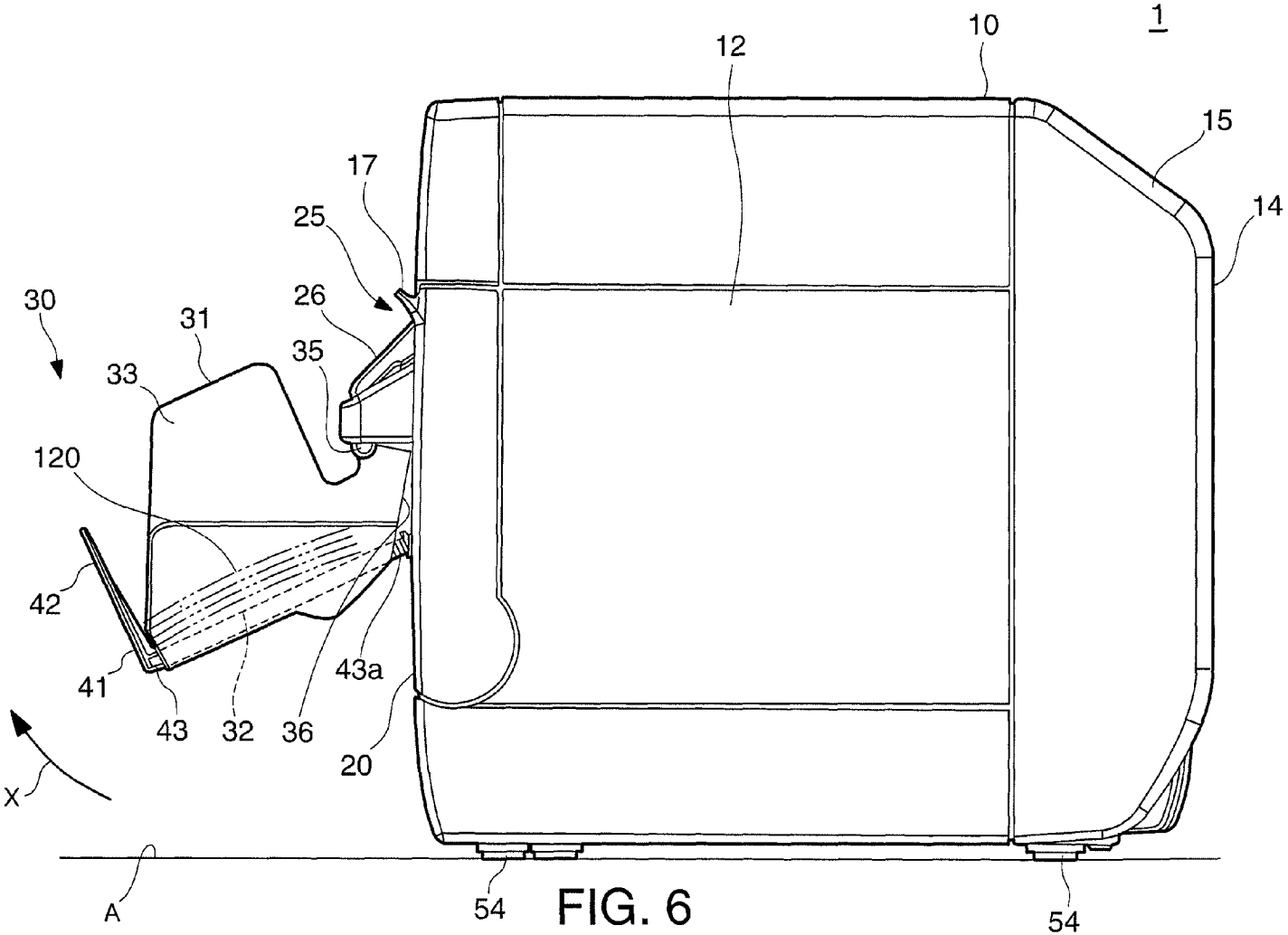
FIG. 6 is a side view of the printer when the length of the discharge tray is shortened.

FIG. 5 is a side view of the printer 1 when the length of the discharge tray unit 30 is increased, and FIG. 6 is a side view of the printer 1 when the length of the discharge tray unit 30 is shortened.

As described above, the discharge tray unit 30 is hinged to the roll paper cover 20 by engaging pins 35, and this discharge tray unit 30 can pivot on these engaging pins 35. Because the engaging pins 35 are disposed to the top part of the side walls 33 of the discharge tray 31 in this embodiment of the invention, the discharge tray unit 30 swings of its own weight to the case 10 side and contacts the front of the roll paper cover 20. When the sliding member 41 is pulled down and the length of the discharge tray unit 30 is extended, the back 36 of the back wall 102 (back end part) of the discharge tray 31 and the front of the roll paper cover 20 touch. As a result, the angle of the paper collection surface 34 of the discharge tray unit 30 becomes steeper, and this position is suitable for receiving long pieces 110 of roll paper 100 because the receiving unit 32 is long. Furthermore, because the angle of the paper collection surface 34 is steep, long pieces 110 can reliably descend to the paper stop 42 without jamming near the paper exit 25, and the pieces 110 can be collected in an orderly stack at this position.

On the other hand, when the length of the discharge tray unit 30 is shortened, the inclination angle of the discharge tray unit 30 changes at the engaging pins 35 to a more horizontal angle than when the length of the discharge tray unit 30 is extended. More specifically, the base end 43*a* (contact part) of the base unit 43 of the sliding member 41 protrudes to the case 10 side from the back wall 102 of the discharge tray 31 when the length of the discharge tray unit 30 is shortened. Because this base end 43*a* protrudes to the case 10 side from the back wall 102 of the discharge tray 31, the base end 43*a* contacts the front of the roll paper cover 20. As a result, the discharge tray unit 30 pivots in the direction of arrow X in FIG. 6, and the inclination angle of the discharge tray unit 30 becomes more level than when the length of the discharge tray unit 30 is extended. This position is suitable for receiving pieces 120 of roll paper 100 when the paper is cut short.

Because the paper stop 42 is close to the paper exit 25 and the inclination angle of the paper collection surface 34 is small, the pieces 120 of roll paper 100 are collected in the receiving unit 32 without turning over or falling out of the receiving unit 32.

Furthermore, because the pieces of roll paper 100 are not turned over and are deposited with the printed side facing up, the printed image can be easily seen with the pieces 120 in a stack on the receiving unit 32. Furthermore, because a slope, though small, is imparted to the paper collection surface 34 of the discharge tray unit 30, the pieces 120 reliably fall to the position of the paper stop 42, and the pieces 120 can be collected in an orderly stack at this position.

The discharge tray unit 30 according to this embodiment of the invention can thus cause the angle of the paper collection surface 34 to change automatically by simply sliding the sliding member 41 to change the length of the receiving unit 32.

A printer 1 according to this embodiment of the invention that records images on roll paper 100 and discharges the printed paper from a paper exit 25 has a cutter unit 80 that cuts the roll paper 100 after an image is recorded, and a discharge tray unit 30 that receives the slips 110, 120 that are cut from the roll paper 100 by the cutter unit 80 and discharged from the paper exit 25. The discharge tray unit 30 is attached by a hinge at an incline to the roll paper cover 20 so that the paper stop 42 disposed to the distal end of the discharge tray unit 30 is down, and is configured so that the length of the discharge tray unit 30 can be adjusted. When the length of the discharge tray unit 30 is shortened, the inclination angle of the discharge tray unit 30 changes as a result of this operation to a more horizontal angle than when the length of the discharge tray unit 30 is extended. As a result, when the length of the discharge tray unit 30 is extended, the inclination angle of the discharge tray unit 30 is steep, pieces 110 that are cut long can descend smoothly over the discharge tray unit 30, and the pieces 110 can be neatly stacked on the discharge tray unit 30. Because the inclination angle of the discharge tray unit 30 changes to a smaller angle so that the discharge tray unit 30 is more horizontal when the length of the discharge tray unit 30 is shortened, the distance between the paper exit 25 and the discharge tray unit 30 is reduced, and pieces 120 that are cut short are prevented from turning over and can be neatly stacked on the discharge tray unit 30.

The discharge tray unit 30 according to this embodiment of the invention has a discharge tray 31 that is hinged to the roll paper cover 20, and a sliding member 41 that is slidably attached to the discharge tray 31. The sliding member 41 has a base end 43*a* part that protrudes to the case 10 side from the back wall 102 of the discharge tray 31 when the length of the discharge tray unit 30 is shortened, and can easily cause the inclination angle of the discharge tray unit 30 to change to a more horizontal angle as a result of the base end 43*a* contacting the front of the roll paper cover 20. The operation that adjusts the length of the discharge tray unit 30 and the operation that changes the inclination angle of the discharge tray unit 30 can thus be executed simultaneously, and operability is improved.

Furthermore, because a mechanism 103 that fixes the sliding member 41 to the discharge tray 31 is disposed between the discharge tray 31 and the sliding member 41, the position of the sliding member 41 to the discharge tray 31 is fixed by the mechanism 103, the length of the discharge tray unit 30 is prevented from changing, and the cut-off slips 110 and 120 that accumulate in the discharge tray unit 30 can be neatly ordered.

It will be obvious to one with ordinary skill in the related art that the embodiment described above is simply one example of how the invention may be applied, and the invention is not limited thereto. For example, a configuration having the paper exit 25 formed in a side of the case 10 is described above, but the paper exit 25 may be disposed in the top of the case 10 if the discharge tray unit 30 can receive the slips 110, 120 that are discharged from the paper exit 25.

In addition, the discharge tray unit 30 in this embodiment of the invention is configured to pivot to the roll paper cover 20 that opens and closes, but the paper exit may simply be an opening in a side or the top of the image recording device, and in this configuration the discharge tray unit 30 is disposed pivotably to the printer case to which externally mounted parts are disposed.

Yet further, the roll paper cover 20 in this embodiment of the invention is supported so that it can pivot to the case 10 of the printer 1 by means of a hinge unit, but may alternatively be configured to open and close to the case by means of a linkage mechanism.

The above embodiment of the invention is described using a roll of label paper as the recording medium by way of example, but the recording medium is not limited to label paper, and other types of continuous sheet media may be used.

An inkjet printer 1 that discharges ink to record images is used by way of example as an image recording device according to the invention, but the invention can also be applied to other types of printers, including thermal printers that record images on thermal paper using a thermal head, dot impact printers, and dye sublimation printers. The invention can also be used in other types of electronic devices having such a printer as a component part.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An image recording device that records images on and discharges continuous paper from a paper exit, comprising:

a device case with a cutter unit that cuts the continuous paper at different lengths after an image is recorded; and a tray unit that has a receiving unit for receiving discharged paper that is cut by the cutter unit and discharged in a discharge direction from the paper exit, wherein the tray unit has a downward incline along the discharge direction at a downward inclination angle, wherein the tray unit is connected to the device case so that the inclination angle at which the distal end part of the receiving unit slopes down can be changed, and is configured so that the length of the tray unit is adjustable when the length of the discharged paper that is cut by the cutter unit varies, and the inclination angle of the tray unit is changed by the operation of shortening the tray unit length, wherein shortening the tray unit length for receiving discharged paper of a first length changes the downward inclination toward a more horizontal angle than when the length of the tray unit is extended for receiving discharged paper of a second length longer than the first paper.

2. The image recording device described in claim 1, wherein:

the tray unit includes a tray that is pivotably connected to the device case, and a sliding member that is slidably attached to the tray; and the sliding member has a contact part that protrudes to the device case side from the back end part of the tray and contacts the device case when the length of the tray unit is shortened.

3. The image recording device described in claim 2, further comprising:

a locking means that is disposed between the tray and the sliding member, and fixes the sliding member to the tray.

4. The image recording device described in claim 1, wherein:

the tray unit is disposed to an access cover, of which the bottom end part is pivotably supported on the device case, so that the distal end part of the receiving unit can pivot up.

* * * * *